US006991219B2

(12) United States Patent
Aharonov et al.

(10) Patent No.: US 6,991,219 B2
(45) Date of Patent: Jan. 31, 2006

(54) ARTICLE HAVING A HARD LUBRICIOUS COATING

(75) Inventors: Robert R. Aharonov, West Bloomfield, MI (US); Raymond P. Fontana, Waldwick, NJ (US); James M. South, Greenville, SC (US)

(73) Assignee: Ionbond, LLC, Madison Heights, MI (US)

( * ) Notice: Subject to any disclaimer, the term of this patent is extended or adjusted under 35 U.S.C. 154(b) by 242 days.

(21) Appl. No.: 10/337,658

(22) Filed: Jan. 7, 2003

(65) Prior Publication Data

US 2004/0129313 A1 Jul. 8, 2004

(51) Int. Cl.
*F15K 31/02* (2006.01)
*F01L 1/14* (2006.01)

(52) U.S. Cl. ..... 251/368; 123/90.48; 123/90.51; 251/129.11; 239/585.1

(58) Field of Classification Search ..... 251/368, 251/129.11; 123/90.48, 90.51; 239/585.1; 427/376.5; 428/408
See application file for complete search history.

(56) References Cited

U.S. PATENT DOCUMENTS 4,269,391 A * 5/1981 Saito et al. ..... 251/315.03
4,811,701 A * 3/1989 Buhl et al. ..... 123/188.3
4,873,150 A * 10/1989 Doi et al. ..... 428/627
4,974,498 A * 12/1990 Lemelson ..... 92/223
5,237,967 A * 8/1993 Willermet et al. ..... 123/90.51
5,249,554 A * 10/1993 Tamor et al. ..... 123/90.51
5,309,874 A 5/1994 Willermet et al. ..... 123/90.51
5,458,927 A * 10/1995 Malaczynski et al. ..... 427/527
5,556,519 A 9/1996 Teer ..... 204/192.12
5,692,723 A 12/1997 Baxter et al. ..... 251/129.21
5,771,873 A 6/1998 Potter et al. ..... 123/668
5,783,261 A 7/1998 Potter et al. ..... 427/526
5,979,866 A 11/1999 Baxter et al. ..... 251/129.21
6,062,498 A 5/2000 Klopfer ..... 239/533.2
6,145,763 A 11/2000 Fleming et al. ..... 239/585.1
6,165,616 A * 12/2000 Lemelson et al. ..... 428/408
6,244,525 B1 6/2001 Gallup et al. ..... 239/533.12
6,267,307 B1 7/2001 Pontoppidan ..... 239/585.4
6,679,231 B2 * 1/2004 Kabat et al. ..... 123/527
6,715,693 B1 * 4/2004 Dam et al. ..... 239/88

FOREIGN PATENT DOCUMENTS

WO WO 01/61182 A1 8/2001

* cited by examiner

*Primary Examiner*—A. Michael Chambers
(74) *Attorney, Agent, or Firm*—Gifford, Krass, Groh, Sprinkle, Anderson & Citkowski, P.C.

(57) ABSTRACT

A valving assembly for a motor vehicle includes a hard, lubricious and chemically inert coating of graphitic carbon. The coating may include a metal. Preferred metals include chromium or other transition metals.

22 Claims, 2 Drawing Sheets

ARTICLE HAVING A HARD LUBRICIOUS COATING

FIELD OF THE INVENTION

This invention relates generally to fluid control devices such as valves. More specifically, the invention relates to valve assemblies for internal combustion engines. Most specifically, the invention relates to fuel injector components having hard, lubricious coatings deposited thereupon.

BACKGROUND OF THE INVENTION

In operation, many components of internal combustion engines are exposed to extremes of temperature and pressure as well as to corrosive environments. Furthermore, such components often operate at very high repetition rates. Fluid control devices of internal combustion engines, such as fuel injector valves, intake valves and exhaust valves, are also required to maintain their dimensional tolerances under such extreme conditions. The prior art has long sought methods, materials and techniques for enhancing the durability and service life of internal combustion engines and their respective components. Toward this end, various components of the engines have been coated with protective materials.

Any such coating should function to protect engine components from extreme operating conditions. In addition, the coatings should decrease friction and/or be wear resistant. In addition, any such coatings should be easy and economical to apply in a high volume production process. The prior art has heretofore encountered problems in implementing such coatings since many of the desired criteria are mutually exclusive. For example, ceramic coatings are very hard and chemically inert; however, such coatings tend to be abrasive, and they are often brittle. Diamond-like carbon coatings have also been investigated for use in internal combustion engines. Such coatings also tend to be brittle; furthermore, scale up of processes for preparing such coatings has been found to be difficult.

Disclosed in the prior art are a number of coatings which have been proposed for use in fluid control systems of internal combustion engines. For example, U.S. Pat. No. 5,783,261 discloses a fuel injector valve which is coated with amorphous carbon that is implanted with a carbide forming material such as silicon, titanium or tungsten. PCT publication WO 01/61182 discloses a fuel injector needle having a coating of diamond-like carbon which contains large amounts of metal carbides. U.S. Pat. No. 5,237,967 discloses a valve lifter coated with an amorphous carbon film including 30–50 atomic percent of hydrogen therein. Similar teachings are found in U.S. Pat. Nos. 5,771,873 and 5,249,554. Ceramic coatings for fuel injector components are disclosed in U.S. Pat. Nos. 5,309,874 and 6,267,307.

Despite the various attempts implemented in the prior art, there has heretofore been no satisfactory coating for use in fluid control devices of internal combustion engines. As will be explained hereinbelow, the present invention provides a hard, lubricious, chemically inert coating for internal combustion engine components. The coating of the present invention is wear resistant, yet it is durable under conditions of repeated mechanical shock. The coatings of the present invention can be deposited by high volume, easy to control sputtering techniques, and have been demonstrated to significantly increase the service life of engine components. These and other advantages of the invention will be apparent from the drawings, discussion and description which follow.

BRIEF DESCRIPTION OF THE INVENTION

There is disclosed herein a valving assembly for a fuel injector. The assembly includes a valve member and a seat member which are selectably engageable so as to control the flow of fuel therebetween. At least a portion of at least one of the valve member and the seat member is coated with a graphitic carbon coating. In particular embodiments, the graphitic coating further includes a metal, which may be present in an amount of 0.5–10 atomic percent. In preferred embodiments, the metal is a transition metal, and in a specifically preferred embodiment it is a group VIa transition metal. One preferred transition metal is chromium.

The coatings of the present invention preferably have low contents of hydrogen, carbides and tetrahedral carbon.

In particular embodiments, the graphitic coating is deposited by a sputtering process, and a specific, preferred process is unbalanced magnetron sputtering.

DETAILED DESCRIPTION OF THE INVENTION

Figure 1:
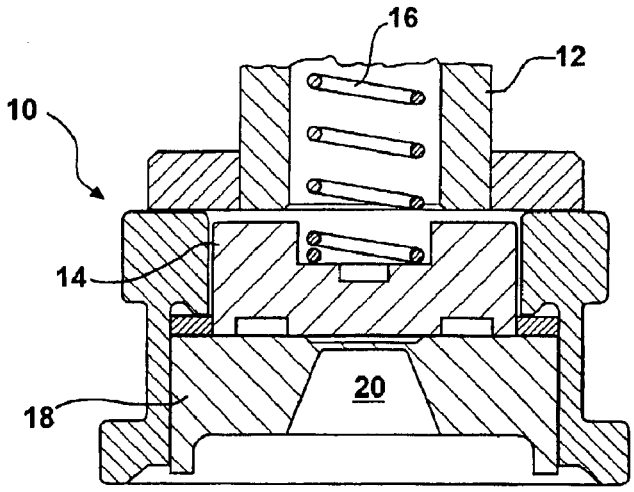
FIG. 1 is a cross-sectional view of a portion of a fuel injector coated in accord with the present invention.

In accord with the principles of the present invention, various components of an internal combustion engine are coated with a hard, inert, lubricious coating of carbon which is characterized as "graphitic." This coating protects the components from corrosive conditions encountered in the engine. In addition, the hard and lubricious nature of the coating decreases wear of the components and frictional losses in the engine, which are particularly significant issues when engines are fueled with alcohol/gasoline mixtures or when the fuel contains water. The graphitic coating is resilient and hence resistant to cracking or other mechanical failure occasioned by repetitive and/or high impact forces encountered in the operation of the engine. Fluid control devices such as components of fuel injectors, intake valves, exhaust valves and the like benefit significantly from the graphitic carbon coatings of the present invention.

Graphitic carbon is known in the art as being a distinct form of deposited carbon, and it may be prepared by a variety of techniques including physical vapor deposition techniques such as sputtering, evaporation, laser ablation, electron beam evaporation and variants thereof. While the prior art acknowledges graphitic carbon as being distinct from amorphous carbon and diamond-like (tetrahedral) carbon, the prior art has not heretofore employed graphitic carbon as a wear resistant, lubricious, protective coating for components of an internal combustion engine; and in fact, the prior art explicitly teaches away from such utility. In this regard, see U.S. Pat. No. 5,237,967.

Graphitic carbon includes a very high proportion of carbon in the $sp^2$ form and a very low proportion of carbon in the $sp^3$, tetrahedral, form. Graphitic carbon, as opposed to amorphous carbon, is essentially non-hydrogenated, and while graphitic carbon coatings may include some small proportion of hydrogen, depending upon the method by which these materials are prepared, any such hydrogen is present in an amount sufficiently low so that the inherent properties of the graphitic carbon are not significantly modified. In this regard, graphitic carbon films are essentially non-hydrogenated, although it is to be understood that such films may include Up to 10 atomic percent hydrogen therein and still be considered graphitic. Graphitic carbon coatings have been found to retain their inherent physical and structural properties in the presence of high levels of moisture. This is in contrast to other non-graphitic carbon coatings, and is believed to be due to their essentially non-hydrogenated nature.

The graphitic carbon coatings employed in the present invention preferably include a metal therein, and this metal is most preferably a transition metal. It is to be understood that transition metals comprise those metals found in groups IIIa–IIb of the periodic table. Since there are presently several conventions for specifying the identity of the a and b groups of the periodic table, it is to be understood that within the context of this disclosure, group IIIa elements are the scandium group elements, and group IIb elements are the zinc group elements, with the remaining groups of the periodic table corresponding to this convention. Some specifically preferred transition metals comprise the group Va–VIIa metals, with the group VIa metals being a specific, preferred group. One preferred transition metal for use in the graphitic films of the present invention comprises chromium. Typically, the metal component of the graphitic carbon coating will be present in the range of 0.5–10 atomic percent, and in some specific embodiments, the metal will comprise 1–4 atomic percent of the coating. The metal component of the coating may comprise a single metal, or it may comprise two or more metals.

It is a notable feature of the coatings employed in the present invention that the carbide content thereof is very low. The metal is primarily non-carbided. In a typical coating of the present invention, the carbide content of the film is less than 0.5 atomic percent.

The graphitic carbon coatings have been found to be particularly advantageous for use in connection with fuel injectors, and the invention will be further explained with reference to fuel injectors; although it is to be understood that the invention is not limited thereto and includes, among other things, other coated valve assemblies such as exhaust and intake valves, fuel and air metering valves, as well as other components of internal combustion engines such as pistons, piston rings, cylinders, bearing surfaces, or any other components which undergo sliding friction in a corrosive and/or high temperature environment. Fuel injectors are of many different designs, but all basically include a valve and seat arrangement wherein a valve member and a seat member are selectably engageable to open and close a fuel flow path defined therebetween. The valve and seat member are required to open and close for every power stroke of their associated piston, and they are exposed to corrosive effects of fuel, high temperatures, and repetitive mechanical stress and impact as well as variations in sliding friction due to the operating environment.

Referring now to FIG. 1, there is shown a cross-sectional view of a portion of a fuel injector 10 which includes the graphitic carbon coating of the present invention. The fuel injector 10 is of the general type disclosed in U.S. Pat. No. 5,979,866, the disclosure of which is incorporated herein by reference. Fuel injectors of this type are electromagnetically activatable, and in this regard, the injector 10 of FIG. 1 includes an electromagnetic core member, a portion of which is shown at reference numeral 12 in FIG. 1. This core member 12 is magnetically coupled to a coil (not shown) and when the coil is activated, the core 12 generates a magnetic field which attracts an armature member 14 (also referred to as a disc) which functions as a valve member. A coil spring 16 provides a biasing force operating against the armature 14, and when the magnetic attraction between the core 12 and armature 14 exceeds the strength of the spring, the armature 14 is displaced toward the core 16 so as to take it out of contact with a valve seat 18 thereby permitting fuel to flow through passages in the armature 14 and out through nozzle openings 20 in the valve seat 18. When the magnetic field is terminated, the biasing spring 16 reestablishes contact between the armature 14 and the valve seat 18 so as to terminate the flow of fuel.

Figure 2:
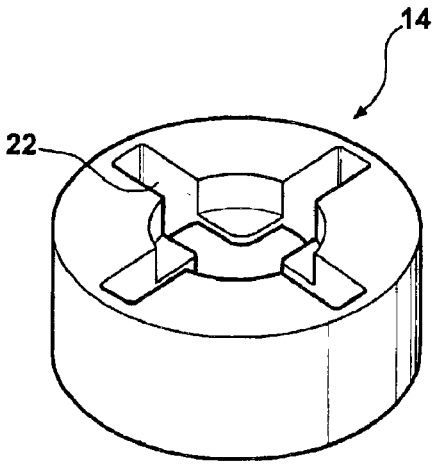
FIG. 2 is an enlarged, perspective view of an armature from the fuel injector of the present invention.

Referring now to FIG. 2, there is shown a perspective view of the armature 22 of FIG. 1 showing the top surface and fluid channels therethrough. In the operation of the fuel injector, the armature is repeatedly displaced by the magnetic core 12, and subsequently snaps back into contact with the valve seat 18. As such, the armature is exposed to repeated impacts, as well as to significant amounts of sliding friction. The armature is made from a high silicon iron, and is hard and abrasive. The armature functions as a valve member and must provide a fluid tight seal against the valve seat 18; and furthermore, it must resist leakage of fuel from the fuel delivery system as well as combustion gasses from the engine cylinder. The corrosive nature of the combustion products and the fuel as well as the high pressure and temperature conditions precludes the use of any sealing element such as O-rings or the like. Therefore, both the armature 14 and valve seat 18 must have, and more importantly maintain, very smooth sealing surfaces if fuel efficiency and pollution standards are to be met by the engine.

In accord with the present invention, a graphitic carbon coating is applied to the armature 14. The coating is applied to the surface of the armature which seals against the valve member 18, and is most preferably applied to substantially all of the surface of the armature. Use of the coating increases the service life of the fuel injector by protecting the armature and valve face from wear and corrosion, while providing a very good sealing surface for the valve member.

Figure 3:
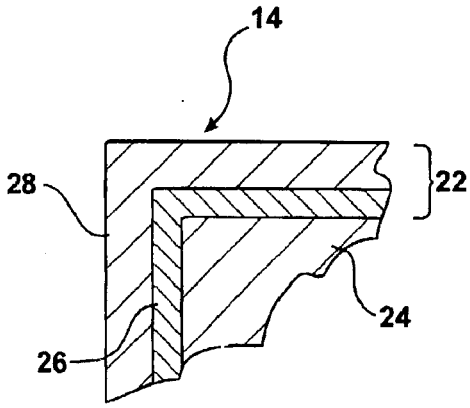
FIG. 3 is an enlarged, partial, cross-sectional view of the armature of FIG. 2 showing the coating of the present invention.

Referring now to FIG. 3, there is shown a cross-sectional view of a portion of an armature having the coating of the present invention disposed thereupon. As shown, the coating 22 is deposited on a base 24 which comprises the body of the armature. In this particular embodiment, the base armature 24 is comprised of a metal injection molded (MIM) component made of iron containing 2.5% silicon. Other embodiments of valve may include components fabricated from different materials, and the graphitic coating of the present invention may be employed with equal advantage in such embodiments also. This material is selected for its magnetic properties. As is known in the art, production steps for the fabrication of the component include molding, heat treating, ferritic nitrocarburizing, deburring and lapping. The final armature product has a precise geometry and uniform magnetic properties, and any coating process must not compromise these parameters. As depicted in this drawing, the coating 22 is a dual layered coating comprised of a bonding layer 26 disposed on the armature body, and the graphitic carbon coating 28 disposed atop the bonding layer 26. The bonding layer 26 functions to increase the bonding of the graphitic carbon layer 28 to the armature body 24. This layer is optional, and its presence and composition will depend upon the base component being coated as well as the specific graphitic carbon coating being employed. In this particular embodiment, the bonding layer 26 is a metallic layer, most preferably a chromium layer, and the graphitic coating 28 is a chromium containing graphitic carbon layer. The graphitic carbon coating 28 includes approximately 1–4 atomic percent of chromium therein, and the graphitic coating is essentially free of metal carbides. The total thickness of the coating 22 is approximately 2.5 microns, and approximately 0.5 microns of this coating is constituted by the bonding layer 26 and the remaining 2 microns of the coating is constituted by the graphitic carbon coating. Other thicknesses may be employed with equal advantage in other embodiments.

While the FIG. 3 drawing shows the interface between the bonding layer 26 and the graphitic layer 28 as being a sharp interface, in some embodiments of the invention, this interface is a graded interface such that the bonding layer 26 is essentially all chromium in the region closest to the armature substrate 24, and the concentration of chromium decreases as the thickness of the bonding layer 26 increases. Likewise, the concentration of graphitic carbon in the coating increases as thickness builds. While such gradation is not essential to the practice of the present invention, it has been found that in this embodiment, adherence of the coating to the underlying armature substrate is enhanced by the use of a graded interface.

A typical coating of the type shown in FIG. 3 has a hardness in the range of 1025–1800 Hv (Vickers), a coefficient of friction in the range of 0.05–0.1, a surface roughness of approximately 0.04 microns, a modulus of elasticity of 150–200 GPa, and an electrical resistivity in the range of $1\times10^{-3}$–$5\times10^{-3}$ Ω-cm. In general, the graphitic coatings of the present invention have a Vickers hardness in the range of 1000–2000, a coefficient of friction in the range of 0.05–0.15, and an electrical resistivity in the range of $1\times10^{-4}$–$1\times10^{-2}$ Ω-cm. However, particular coatings of the present invention may have values outside of their ranges.

While the coatings of the present invention may be prepared by a variety of deposition processes, physical vapor deposition processes may be employed with particular advantage. Sputtering processes comprise one particularly preferred group of physical vapor deposition processes since they are easy to control and readily scalable to accommodate large volumes. In general, non-reactive sputtering processes are employed. Magnetron sputtering processes are one class of specifically preferred process, and unbalanced magnetron sputtering is employed with advantage in particular embodiments of the invention. Unbalanced magnetron sputtering techniques and apparatus are disclosed in U.S. Pat. No. 5,557,519, the disclosure of which is incorporated herein by reference.

Figure 4:
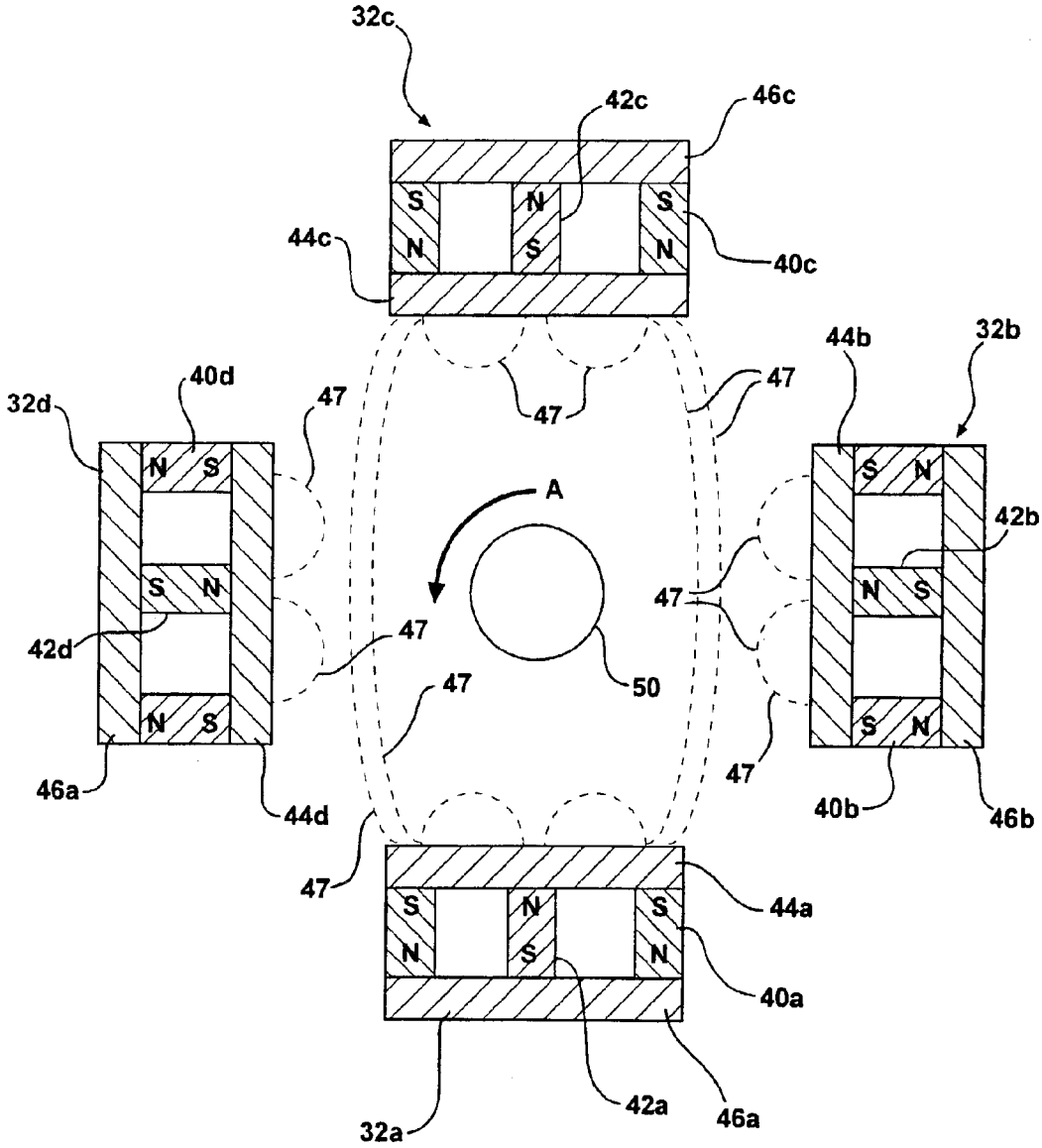
FIG. 4 is a schematic depiction of a sputtering apparatus which may be employed in the practice of the present invention.

Referring now to FIG. 4, there is shown a schematic depiction of a magnetron sputtering apparatus which may be used in the practice of the present invention. The system of FIG. 4 includes four magnetron units 32*a*, 32*b*, 32*c* and 32*d*. In other embodiments of apparatus, a larger or smaller number of magnetron units may be employed. Each magnetron includes an outer ring magnet 40*a*–40*d* and a central core magnet 42*a*–42*d*. The polarity of the core magnet 42 is opposite that of the ring magnet 40. The magnetrons each include a sputtering target 44*a*–44*d* on their inner, working surface. As is known in the art, at least the front face of this target (also known in the art as a cathode) is comprised of the material which is to be sputtered. The back surface of each magnetron is constituted by a plate 46*a*–46*d* of a magnetic material such as soft iron. This plate 46 serves to complete the magnetic circuit through the magnetron. FIG. 4 illustrates the magnetic flux lines 47 which are established by the magnetrons.

The apparatus of FIG. 4 further includes a substrate support 50 disposed interiorly thereof. As shown, the substrate support 50 is configured to be rotatable, as is indicated by arrow A, although fixed substrate supports may be employed in particular embodiments of the invention. The substrate support may also be heatable so as to maintain the substrates at an elevated temperature. Although not illustrated, the apparatus of FIG. 4 is enclosed in a vacuum chamber which is capable of sustaining and maintaining a subatmospheric pressure of a preselected atmosphere. The chamber includes gas delivery lines and exhaust lines. Also, the chamber includes a power supply which serves to establish an electrical field between the substrate holder 50 and the targets 44 of the magnetrons 32. In operation, the chamber is filled with a low pressure atmosphere of a working gas such as argon. The electrical field ionizes the working gas which is accelerated and strikes the targets 44 thereby ejecting material therefrom. This material is attracted to the electrically biased substrates supported on the holder 50 and impacts upon forming a deposit. By choice of target material and activating fields applied to each target material, the rate of film deposition from a particular target may be controlled. In the magnetron apparatus, the magnetic field created by the magnetron serves to confine and direct electrons so as to maximize the coating process. In a typical apparatus for the practice of the present invention, two of the targets, for example targets 44*b* and 44*d*, are made of carbon, and the other two targets, for example targets 44*a* and 44*c*, are made of chromium. In some embodiments, one of the chromium targets is substituted for by a target of titanium, which is used to passivate the chamber prior to commencement of deposition by removing stray oxygen. This process is known as "gettering" and methods for its use are well known in the art.

The present invention will be described with reference to a particular coating process carried out by an unbalanced magnetron sputtering technique utilizing an apparatus as generally described hereinabove for coating a graphitic carbon coating onto armatures of the type generally shown in FIG. 2. Prior to the coating process, the armatures are cleaned in a caustic detergent solution (Chem Crest 275 at a 10% concentration). Cleaning was carried out in an ultrasonic washer at 160° F. for 5 minutes following which the parts were rinsed with a 2% rust inhibitor solution (Chem Crest 77) at 120° F. for 5 minutes, following which they were spray rinsed with deionized water at 120° F. for 30 seconds. The parts were then again treated with the rust inhibitor and re-rinsed with deionized water as above. The parts were then dried in a stream of filtered hot air at 250° F. for 5 minutes. Alternatively, the parts may be cleaned using a non-aqueous, non-aromatic solvent, such as the product sold under the name Lotoxane® by AIM Inc. of Montreal, Canada.

Approximately 4,000 of the cleaned armature parts were placed on a carousel type support and loaded into an apparatus of the type shown in FIG. 4. The system was pumped down and flushed with argon, and the working pressure therein was adjusted to 0.6 mTorr. In a first step of the process, the substrates were plasma cleaned. This was accomplished by imposing a bias of approximately −400 volts on the substrate holder. The biasing voltage had a base frequency of 250 kHz, and it was pulsed at an on-off rate of 500 nanoseconds. The magnetrons employed in this coating process had a length of approximately 27 inches, and a current of 0.4 amp was established through the chromium targets, and a current of 0.2 amp was established through the carbon targets. This current and voltage condition did not produce any significant deposition onto the armatures; but, produced an ion bombardment which served to clean the armatures. This cleaning step was carried out for approximately 30 minutes.

Following the cleaning step, the chromium bonding layer was deposited. This was accomplished by setting the bias voltage to −120 volts and increasing the current flow to the chromium target to 4 amps. No current flowed through the other chromium target or through either of the carbon targets. This deposition was carried out for approximately 12 minutes, after which the graded composition transition zone was prepared. In this regard, the bias voltage was decreased to −60 volts, and the frequency of the biasing voltage was lowered to 50 kHz and the on-off cycle time was increased to 1500 ns. The background working pressure of 0.6 mTorr of argon was maintained throughout the entire process. The deposition of the transition zone occurred over approximately 30 minutes, and during this time, the current flow through the chromium target was lowered from an initial current of 4.0 amps to a final current of 0.25 amps. During this same time, the current through each of the carbon targets was ramped up from 0.25 amps to 3.0 amps.

Following the deposition of the transition zone, the graphitic coating was deposited. In this regard, all conditions were maintained as they were at the end of the deposition of the transition zone. That is to say, current through the carbon targets was maintained at 3.0 amps, and current through the one chromium target was maintained at 0.25 amp. This coating step was carried out for 180 minutes. This process produced a coating of approximately 2.5 microns thickness, and the coating had properties as described above.

The wear performance of this coating was measured on a CSEM high temperature tribometer by applying a 15 N (1.5 kg) load to a 6 mm diameter tungsten carbide ball at a rotational speed of 500 rpm. The wear track for the testing was 7 mm in diameter. Several runs were made, and each sample was run for 1–2 hours and the wear rate calculated. Even after 2 hours under these conditions, only a small amount of coating wear was apparent. The wear rate as measured was in the range of $5–9\times10^{-17}$ $m^2/N$.

A second coating run was carried out under conditions basically as described with regard to the first run. Generally higher target currents were maintained. Specifically, during the ion cleaning step current through the two chromium targets was maintained at 1.0 amp, and current through the two carbon targets at 0.5 amp. During this run, the chromium deposition was carried out at a chromium target current of 6.0 amp, and in the deposition of the transition zone, current through the chromium target ramped down over 30 minutes from 6.0 amp to 0.25 amp, while current through the two carbon targets ramped up from 0.25 to 6.0 amp. During the deposition of the graphitic coating, current through the chromium target was maintained at 0.6 amp, and current through the two carbon targets at 6.0 amp. All other parameters of the process were maintained as in the first run. This process produced a coating having a surface roughness of 0.02 microns, a Vickers hardness of 1215, a modulus of elasticity of 167 GPa, a coefficient of friction of 0.08–0.10, and a wear rate, calculated as previously, of $3\times10^{-16}$ $m^2/N$.

It has been found that armatures coated with the graphitic coating of the present invention exhibit very long service life, and typically maintain precise tolerances so that the dynamic flow shift of fuel therethrough varies by less than 5% over 600 million operational cycles. Current predictions based upon work in progress indicate that this variance will drop to 3% or below in the near future. The sputtering process is reliable, repeatable, and simple to control. Furthermore, the parameters of the process can be readily scaled to accommodate large batches.

The foregoing examples have described coatings of graphitic carbon which include chromium. It is to be understood that the coatings used in the present invention are not so limited. For example, one of skill in the art will recognize that other metals, such as vanadium, molybdenum and tungsten, may be readily substituted for chromium. Furthermore, metal free, graphitic films can also be used in the practice of this invention.

It is to be noted that while the invention has been described with reference to a specific configuration of fuel injector valve component, the invention is not to be limited thereto. Fuel injectors of other configurations may be likewise incorporated into the present invention as may be other fluid control components of internal combustion engines such as intake valves, exhaust valves, carburetor parts and the like. The invention has applicability wherever a low friction, durable and inert surface is required. This invention has broad utility in the general field of gas and liquid flow control devices, including injection valves for natural gas, propane and hydrogen powered devices, as well as for devices used in compressors and the like.

Also, while the preferred magnetron sputtering process for the preparation of the coatings used in the present invention has been described, the invention is not to be limited to coatings produced by this process. Other coating processes, including other physical vapor deposition processes, may be readily implemented by one of skill in the art. Accordingly, the foregoing drawings, discussion and description are meant to be illustrative of the present invention, but are not meant to be limitations upon the practice thereof. It is the following claims, including all equivalents, which define the scope of the invention.

What is claimed is:

1. A valving assembly for a fuel injector, said valving assembly comprising:

a valve member and a seat member, said valve member and said seat member being selectably engageable so as to control the flow of a fuel therebetween, wherein at least a portion of at least one of said valve member and said seat member is coated with an essentially graphitic carbon coating which contains no more than 10 atomic percent of hydrogen.

2. The valving assembly of claim 1, wherein said graphitic carbon coating further includes a metal.

3. The valving assembly of claim 2, wherein said graphitic carbon coating includes 0.5–10 atomic percent of said metal.

4. The valving assembly of claim 2, wherein said metal is a transition metal.

5. The valving assembly of claim 4, wherein said transition metal is a Group Va–VIIa transition metal.

6. The valving assembly of claim 4, wherein said transition metal is a Group VIa transition metal.

7. The valving assembly of claim 4, wherein said transition metal is chromium.

8. The valving assembly of claim 4, wherein said transition metal comprises 1–4 atomic percent of said coating.

9. The valving assembly of claim 2, wherein said graphitic carbon coating includes no more than 0.5 atomic percent of a metal carbide.

10. The valving assembly of claim 1, wherein said coating has a thickness in the range of 1–5 microns.

11. The valving assembly of claim 1, wherein no more than 20 atomic percent of said graphitic carbon coating is comprised of tetrahedral carbon.

12. The valving assembly of claim 1, wherein said graphitic carbon coating is a sputtered coating.

13. The valving assembly of claim 2, wherein said coating is a co-sputtered film of graphitic carbon and said metal.

14. The valving assembly of claim 2, wherein said coating is is prepared by a non-reactive sputtering process.

15. The valving assembly of claim 14, wherein said non-reactive sputtering process is an unbalanced magnetron sputtering process.

16. The valving assembly of claim 1, wherein a metallic bonding layer is disposed beneath said graphitic carbon coating.

17. The valving assembly of claim 16, wherein said metallic bonding layer has a thickness in the range of 0.2–0.8 microns.

18. The valving assembly of claim 16, wherein said bonding layer comprises chromium.

19. The valving assembly of claim 16, wherein the interface between said bonding layer and said graphitic carbon coating is compositionally graded.

20. The valving assembly of claim 1, wherein said coating has a film hardness in the range of 1000–2000 Vickers, and a coefficient of friction in the range of 0.05–0.15.

21. The valving assembly of claim 1, wherein said coating has an electrical resistivity in the range of $1\times10^{-3}$–$5\times10^{-3}$ Ω-cm.

22. A valving assembly for an internal combustion engine, said valving assembly comprising;

a valve member and a seat member, said valve member and said seat member being selectably engageable so as to control the flow of a fluid therebetween, wherein at least a portion of at least one of said valve member and said seat member is coated with a carbon coating, said coating including 1–4 atomic percent of a transition metal, no more than 10 atomic percent of hydrogen and no more than 0.5 atomic percent of a metal carbide, said coating being further characterized in that it has a hardness in the range of 1000–2000 Vickers, a coefficient of friction of 0.05–0.15, and an electrical resistivity in the range of $10\times10^{-4}$–$1\times10^{-2}$ Ω-cm.

* * * * *